US006464259B1

(12) United States Patent
Krämer

(10) Patent No.: US 6,464,259 B1
(45) Date of Patent: Oct. 15, 2002

(54) DEVICE FOR INSTALLING A TOILET

(75) Inventor: Jörg Krämer, Merzig (DE)

(73) Assignee: Villeroy & Boch AG, Mettlach (DE)

( * ) Notice: Subject to any disclaimer, the term of this patent is extended or adjusted under 35 U.S.C. 154(b) by 18 days.

(21) Appl. No.: 09/651,346

(22) Filed: Aug. 29, 2000

(30) Foreign Application Priority Data

Apr. 3, 2000 (DE) ..... 100 16 910

(51) Int. Cl.[7] ..... E03D 11/00

(52) U.S. Cl. ..... 285/56; 285/58; 285/60; 4/252.1

(58) Field of Search ..... 285/56–60; 4/252.1–252.5; E03D 11/13

(56) References Cited

U.S. PATENT DOCUMENTS

| | | | | |
|---|---|---|---|---|
| 1,389,004 A | | 8/1921 | Johnston | |
| 2,479,837 A | | 8/1949 | Hollaender | |
| 2,899,690 A | | 8/1959 | Clifford | |
| 3,015,501 A | | 1/1962 | Minella | |
| 3,140,104 A | | 7/1964 | Cosper | |
| 3,263,244 A | | 8/1966 | Katz | |
| 3,281,867 A | | 11/1966 | Pope | |
| 3,967,836 A | | 7/1976 | Izzi, Sr. | |
| 4,171,548 A | | 10/1979 | Wilson | |
| 5,819,326 A | | 10/1998 | Kobayashi et al. | |
| 6,254,141 B1 | * | 7/2001 | Piper | 285/56 |
| 6,292,956 B1 | * | 9/2001 | Kayahara | 4/421 |

FOREIGN PATENT DOCUMENTS

| | | |
|---|---|---|
| JP | 9-316982 | * 12/1997 |
| JP | 10-37283 | * 2/1998 |

* cited by examiner

*Primary Examiner*—Lynne H. Browne
*Assistant Examiner*—Aaron Dunwoody
(74) *Attorney, Agent, or Firm*—Friedrich Kueffner

(57) ABSTRACT

A device for installing a toilet, having a rearwardly extending discharge pipe, on a floor opening, surrounded by a floor ring anchored in the floor and having upright threaded bolts configured to fasten a toilet having a downwardly extending discharge pipe, has a base having an underside configured to be placed onto the floor ring. A U-shaped pipe section having a first end and a second end is provided wherein the first end has a 90° bend section connected to the base. The second end has a diameter matched to a diameter of a rearwardly extending discharge pipe of a toilet to be installed. The 90° bend section has an end portion facing the floor ring, wherein the end portion has a diameter matched to a diameter of the floor ring. The base has securing elements secured to the floor indirectly by the floor ring, the threaded bolts, and the base.

11 Claims, 3 Drawing Sheets

DEVICE FOR INSTALLING A TOILET

BACKGROUND OF THE INVENTION

1. Field of the Invention

The invention relates to a device for installing a toilet, having a rearwardly extending discharge pipe, i.e., extending toward the building wall, and openings in the sidewalls for penetration by fastening screws which are to be threaded into securing elements anchored on the floor, on a floor opening provided for a toilet with downwardly oriented discharge pipe, wherein the floor opening is surrounded by a floor ring anchored on the floor and having upright threaded bolts for fastening the latter toilet.

2. Description of the Related Art

The floor opening according to U.S. standards is positioned at a spacing of 10, 12 or 14 inches from the building wall. In most cases the spacing is 12 inches. The pipe of the floor opening has a diameter of 3 inches. The toilets are accordingly dimensioned and configured. They have a downwardly open, shallow annular space whose inner wall is formed by a pipe stub that is matched to the floor opening and is arranged above it. The annular space receives a wax compound for sealing between the toilet and the aforementioned floor ring. When arranging the toilet with the pipe stub axially above the floor opening, the aforementioned threaded bolts are received in openings of laterally projecting base portions of the toilet. The toilet is fastened by nuts placed and tightened on the threaded bolts. The nuts are subsequently covered by caps.

SUMMARY OF THE INVENTION

It is an object of the present invention to make it possible to install a toilet of the first mentioned kind on a floor opening mentioned above.

In accordance with the present invention, this is achieved in that a device is provided having a base to be placed onto the aforementioned floor ring and to be fastened by using the aforementioned threaded bolts, wherein a U-shaped pipe section with a 90° bend section on one of the U-legs is attached to or formed on the base, wherein the end of the free U-leg is matched to the diameter of the discharge pipe of the first mentioned toilet and can be connected thereto and wherein the end of the aforementioned bend section is matched to the other diameter of the floor opening and can be placed thereabove, and wherein the aforementioned securing elements are connected to or formed on the base, wherein the anchoring of the securing elements on the floor is provided indirectly by the aforementioned floor ring, the threaded bolts, and the base.

According to a further embodiment of the invention the aforementioned bend section has at the outer side of the bend a slanted, flattened portion such that the lower end of the flattened portion is a secant across the circular cross-section of the end portion of the aforementioned bend section.

Accordingly, the toilet can be placed onto the floor opening positioned at a 12 inch spacing from the building wall with a gap-free connection to the building wall without the lower U-leg of the pipe section being in the way of the siphon of the toilet.

Despite this arrangement, a pipe stub provided at the underside of the base as an end portion of the bend section can be provided with a complete circular cross-section in that, according to a further embodiment of the invention, the circular segment of the pipe stub outside of the secant is covered by a cover of the base.

In the same manner as in regard to the aforementioned toilet with the downwardly extending discharge pipe, the base should also have a shallow, downwardly open annular space for receiving an annular seal in the form of a sealant compound. The radially inner wall of the annular space is defined by the pipe stub.

According to a further advantageous embodiment of the invention, the base is rectangular and the aforementioned securing elements, preferably upright plates, are arranged at the corners of the base.

By having a rectangular configuration, the attachment of the toilet at the securing elements is more stable than with a round base designed to match the aforementioned floor ring.

This attachment is better suited to withstand impact etc. from the side which imparts to the toilet the tendency to topple over with lifting at the side where the impact occurs. The corner of the base which is positioned diagonally opposite the upright securing element acts as a support with a longer leverage.

The securing elements can be provided in a manner known to a person skilled in the art with several screw holes wherein the screws are self-tapping screws which, when screwed into one of the holes, will cut their own thread.

DESCRIPTION OF THE PREFERRED EMBODIMENTS

Figure 4:
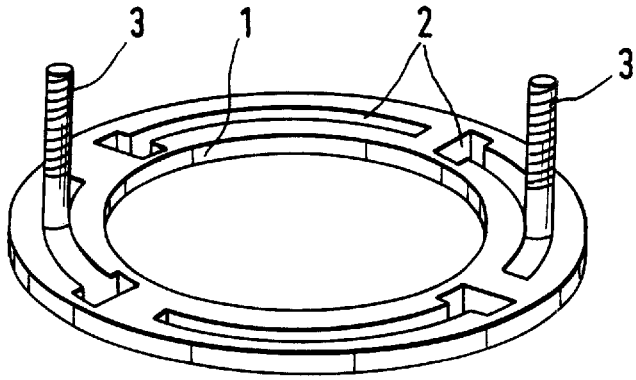
FIG. 4 is an isometric representation of the floor ring provided in a floor of a building.

The floor opening for a toilet is surrounded by the floor ring 1 illustrated in FIG. 4 which is anchored (not shown) within the floor in a manner known in the prior art. Threaded bolts 3 having heads engaging underneath the floor ring 1 are secured in slotted holes 2 of the floor ring 1.

Figure 1:
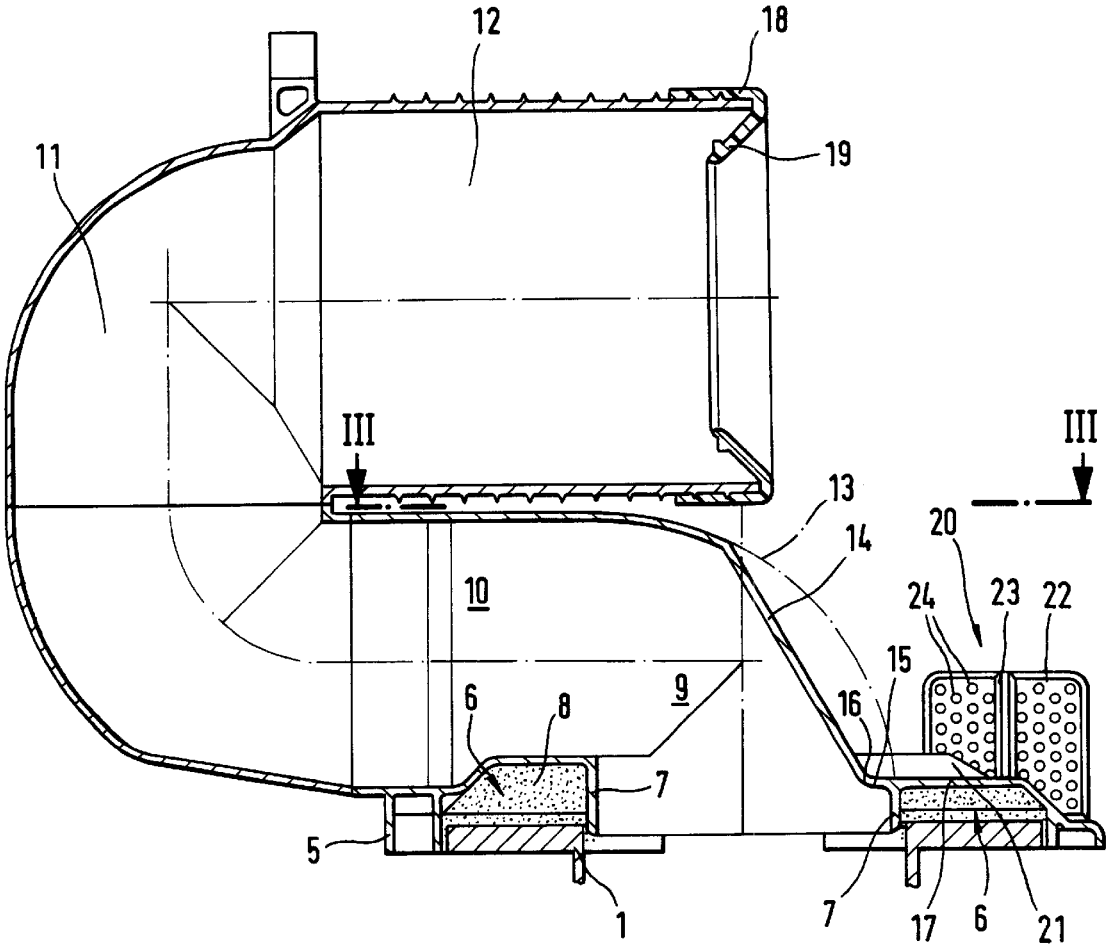
FIG. 1 shows a device according to the invention in a vertical axial section.
Figure 2:
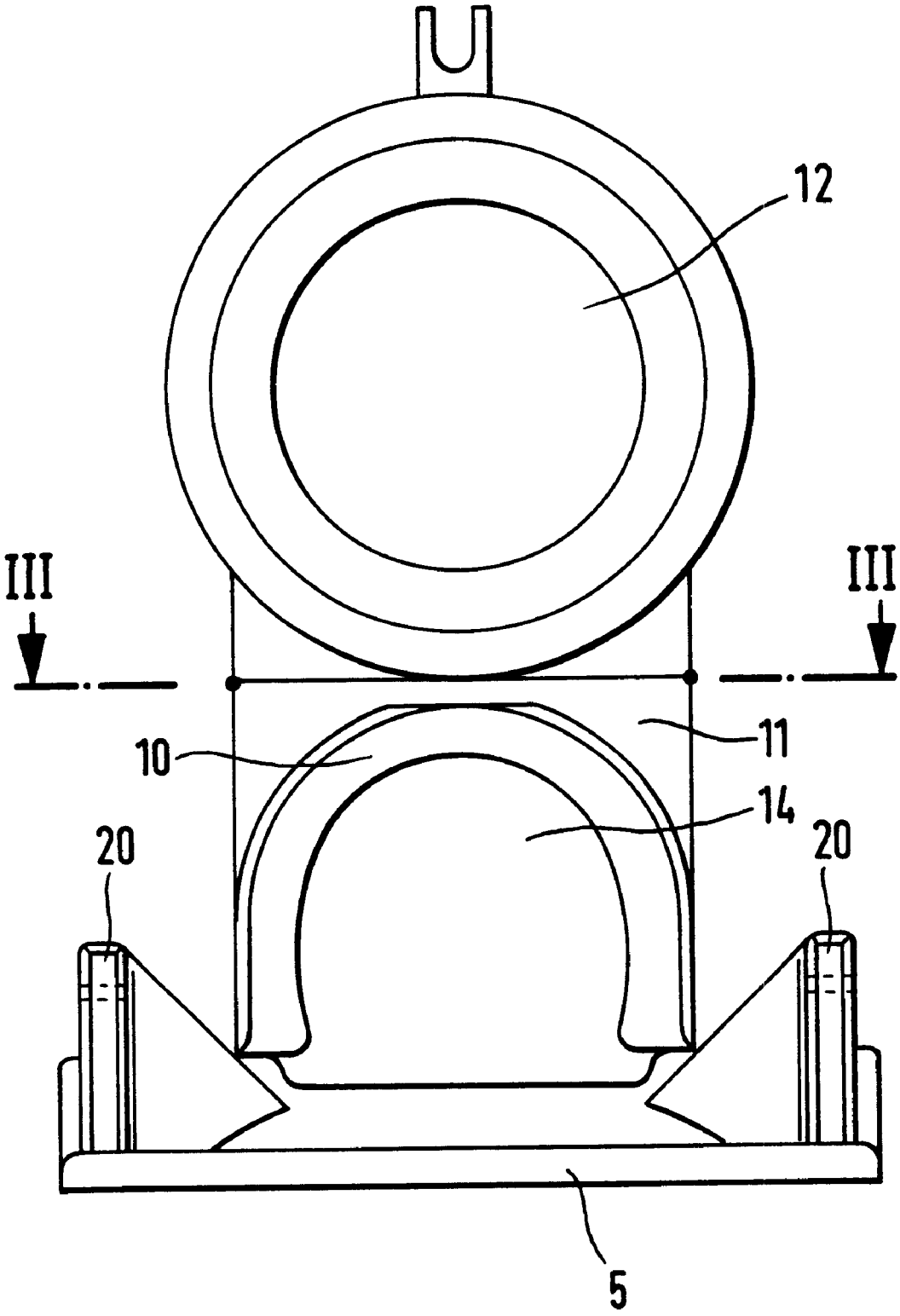
FIG. 2 shows the device according to FIG. 1 in a view from the right of FIG. 1.
Figure 3:
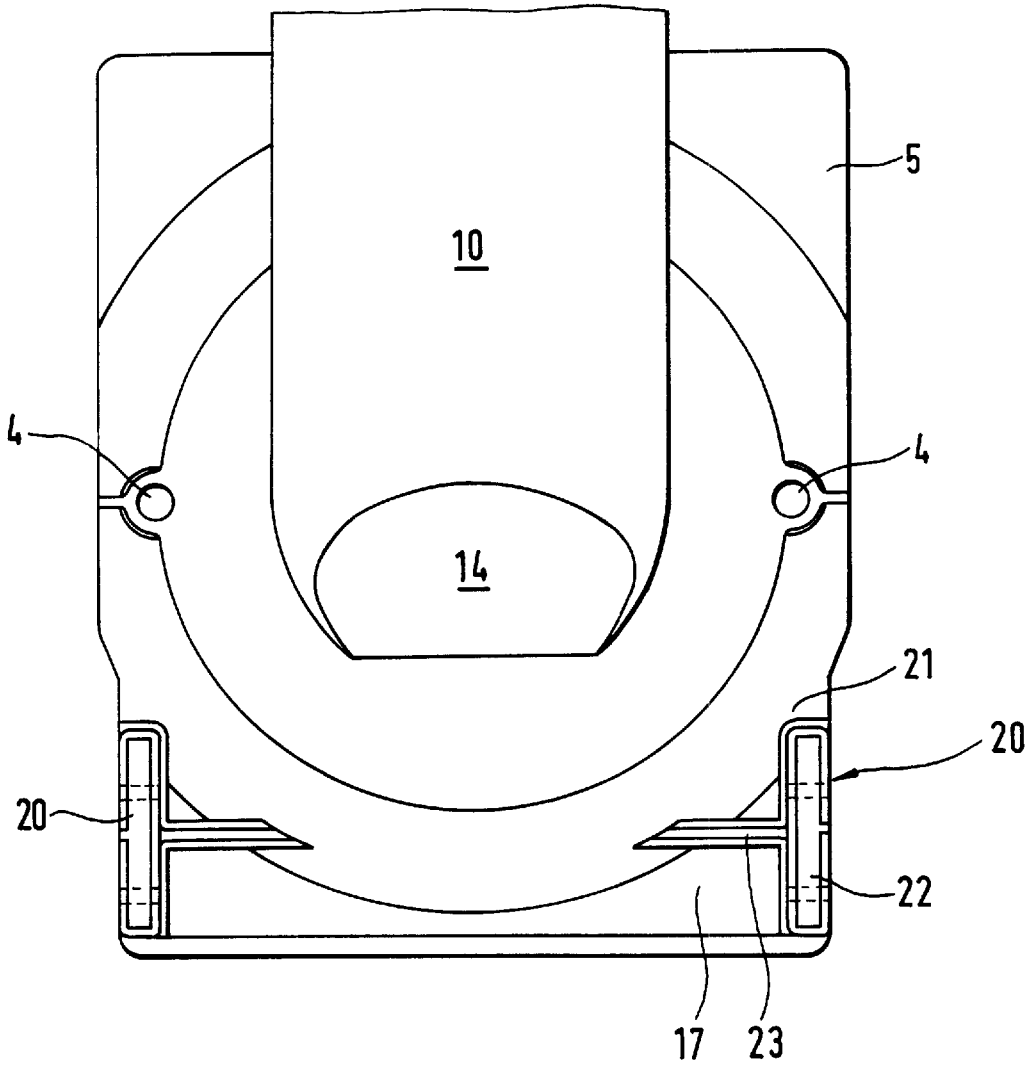
FIG. 3 shows the device in a section along section line III—III in FIGS. 1 and 2.

The device represented in FIGS. 1 through 3 is designed to be placed onto the floor ring 1 on the floor, wherein the threaded bolts 3 penetrate through openings 4 (FIG. 3) provided in a base 5 of the device.

The floor ring 1 is received in this context in an annular space 6 provided at the underside of the base 5. The annular space 6 is limited radially inwardly by a pipe stub 7 positioned axially above the floor opening. The annular space 6 above the floor ring 1 is filled with a wax-like sealant compound 8. The sealant compound 8 seals between the pipe stub 7 and the floor opening.

The pipe stub 7 is connected by a 90° bend section 9 to the first end of the U-shaped pipe section 11 at the lower U-leg 10. The upper U-leg 12 of the pipe section 11 extends parallel to the lower U-leg 10 at a minimal spacing above the lower U-leg 10. The diameter of the pipe section 11 decreases from the second end, where it is configured to match the diameter of 100 mm of the discharge pipe of the toilet to be installed, to the first end with the pipe stub 7 configured to match the diameter of the floor opening of three inches.

The 90° bend section 9 has a slanted, flattened portion 14 instead of the normal curvature 13 indicated in dash-dot line.

The circular segment 15 between the lower end 16 of the flattened portion 14 and the circular arc of the cross-section of the pipe stub, relative to which the lower end 16 forms a secant, is covered by a continued cover 17 of the base 5.

The arrangement of the sealant compound 8 is, however, such that the wall of the pipe stub 7 can also extend flattened at the secant.

A sealing sleeve 18 is seated on the free end of the U-leg 12 which, on the one hand, tightly surrounds the outer mantle surface of the U-leg 12 and, on the other hand, has an inwardly folded portion 19 which seals tightly the inserted discharge pipe of the toilet to be installed on the floor opening. With a different type of sealing sleeve it would also be possible to connect a discharge pipe that ends with some spacing from the U-leg 12.

The toilet is fastened to the securing elements 20 located at the two corners of the rectangular base 5.

The securing elements 20 are comprised of two parallel upright perforated plates 22 projecting from the cover of the base 5, partially in the area of a projection 21 above the annular space 6, and are reinforced in the lateral direction by brace walls 23.

The sidewalls of the toilet are positioned in the floor area adjacent to the perforated plates 22. Openings are arranged in the toilet sidewalls and screws are inserted through these openings and penetrate the screw holes 24 of the perforated plates 22. The screws are self-tapping screws and cut their own thread in these screw holes 24.

As mentioned already in regard to connecting the discharge pipe of the toilet to the U-leg 12, a certain variation range is provided by means of the securing elements 20 for arranging the toilet as needed with respect to its spacing to the building wall.

While specific embodiments of the invention have been shown and described in detail to illustrate the inventive principles, it will be understood that the invention may be embodied otherwise without departing from such principles.

What is claimed is:

1. A device for installing a toilet, having a rearwardly extending discharge pipe, on a floor opening, being surrounded by a floor ring anchored in the floor and having upright threaded bolts configured to extend through openings in sidewalls of a toilet to fasten the toilet having a downwardly extending discharge pipe, the device comprising:

a base having an underside configured to be placed onto the floor ring and to be secured by the bolts;

a U-shaped pipe section having a first end and a second end and connected to the base;

wherein the first end has a 90° bend section;

wherein the second end has a diameter configured to match a diameter of a rearwardly extending discharge pipe of a toilet to be installed;

wherein the 90° bend section has an end portion facing the floor ring, wherein the end portion has a diameter configured to match a diameter of the floor ring;

the base having securing elements configured to fasten the toilet to be installed, the toilet being in this way secured to the floor indirectly by the floor ring, the threaded bolts, and the base.

2. The device according to claim 1, wherein the 90° bend section has an outer side and wherein the outer side has a slanted flattened portion.

3. The device according to claim 1, wherein the flattened portion has a lower end facing the floor ring and wherein the lower end is a secant across a circular cross-section of the end portion of the 90° bent section.

4. The device according to claim 3, wherein the end portion is a pipe stub projecting downwardly from the underside of the base.

5. The device according to claim 4, wherein the pipe stub has a complete circular cross-section and wherein an area of the pipe stub between the secant of the lower end and a circular arc portion of the pipe stub defined by the secant is covered by a cover of the base.

6. The device according to claim 4, wherein the underside of the base has a downwardly open annular space delimited radially inwardly by the pipe stub, wherein the annular space is configured to receive an annular seal configured to seal the device relative to the floor ring.

7. The device according to claim 6, wherein the annular seal is a sealant compound.

8. The device according to claim 1, wherein the base is rectangular and wherein the securing elements are arranged on corners of the base.

9. The device according to claim 8, wherein the securing elements are upright plates.

10. The device according to claim 8, wherein the securing elements have several fastening holes configured to cooperate with self-tapping screws for securing the toilet to the device.

11. The device according to claim 1, comprising a sealing sleeve seated on the second end of the U-shaped pipe section, the sealing sleeve having an outer portion tightly surrounding an outer mantle surface of the second end and having an inwardly folded portion configured to tightly seal the rearwardly extending discharge pipe inserted into the second end.

* * * * *